US005689758A

United States Patent [19]

Wataki et al.

[11] Patent Number: 5,689,758

[45] Date of Patent: *Nov. 18, 1997

[54] IMAGE-TRANSFER AND SHEET-SEPARATION APPARATUS

[75] Inventors: Ryuji Wataki, Nara-ken; Shigeo Fujita, Moriguchi, both of Japan

[73] Assignee: Mita Industrial Co., Ltd., Japan

[ * ] Notice: The term of this patent shall not extend beyond the expiration date of Pat. No. 5,408,300.

[21] Appl. No.: 560,508

[22] Filed: Nov. 17, 1995

Related U.S. Application Data

[63] Continuation of Ser. No. 267,938, Jul. 6, 1994, abandoned, which is a continuation of Ser. No. 958,733, Oct. 9, 1992, Pat. No. 5,408,300.

[30] Foreign Application Priority Data

Oct. 18, 1991 [JP] Japan ..... 3-271064

[51] Int. Cl.[6] ..... G03G 15/00

[52] U.S. Cl. ..... 399/45; 399/314

[58] Field of Search ..... 355/274, 277, 355/276, 271, 219; 399/45, 66, 313, 314, 315, 389

[56] References Cited

U.S. PATENT DOCUMENTS

| | | | |
|---|---|---|---|
| 3,860,857 | 1/1975 | Namiki et al. | 355/276 |
| 4,081,212 | 3/1978 | Wetzer | 355/274 |
| 4,190,348 | 2/1980 | Friday | 355/274 |
| 4,353,648 | 10/1982 | Tanaka et al. | 355/315 |
| 4,363,550 | 12/1982 | Toshimitsu et al. | 355/315 |
| 4,431,301 | 2/1984 | Hashimoto et al. | 355/274 |
| 4,449,808 | 5/1984 | Abreu | 355/274 |
| 4,903,081 | 2/1990 | Takahashi | 355/274 |
| 5,006,902 | 4/1991 | Araya | 355/271 |
| 5,101,238 | 3/1992 | Creveling et al. | 355/271 |
| 5,101,239 | 3/1992 | Nishikawa et al. | 355/274 |
| 5,130,752 | 7/1992 | Morishita et al. | 355/274 |
| 5,132,654 | 7/1992 | Walgrove, III et al. | 355/315 |
| 5,253,022 | 10/1993 | Takeuchi et al. | 355/274 |
| 5,276,489 | 1/1994 | Kikuchi et al. | 355/274 |
| 5,317,371 | 5/1994 | Monma et al. | 355/274 |
| 5,408,300 | 4/1995 | Wataki et al. | 355/276 |

FOREIGN PATENT DOCUMENTS

| | | | |
|---|---|---|---|
| 2915649 | 11/1979 | Germany | 355/276 |
| 0147152 | 11/1981 | Japan | 355/276 |
| 0044472 | 3/1983 | Japan | 355/276 |
| 0086878 | 3/1992 | Japan | 355/276 |
| A-2 204 508 | 11/1988 | United Kingdom . | |

OTHER PUBLICATIONS

Xerox Disclosure Journal, vol. 4, No. 2, Apr. 1979, p. 143, by Bruce W. Friday, entitled "Lead Edge Transfer Switching".

(List continued on next page.)

*Primary Examiner*—Robert Beatty

*Attorney, Agent, or Firm*—Beveridge, DeGrandi, Weilacher & Young, LLP

[57] ABSTRACT

An image-transfer and sheet-separating apparatus transfers an image toner-developed from a positive latent image and retained on a photoconductor drum onto a copy sheet, and subsequently separates the sheet from the photoconductor drum. A bias voltage including a sheet peel-separating AC voltage superimposed on an image-transferring DC bias voltage is applied to a transfer roller which presses on the photoconductor drum. A post image-transfer charge-stripping element removes charge from the copy sheet and is disposed in a portion of the sheet-transport stream forward of a nipping position at which the transfer roller presses against the photoconductor drum. Thus, charge remaining on the copy sheet is discharged, ensuring high efficiency in image transfer and accordingly reducing the incidence of failure in the separation of the copy sheet from the photoconductor drum. The bias voltage is within the range of 500 V and 2000 V and specifically, the AC and DC biases are within the range of 1000 V and 1500 V. In addition, the transfer roller is moved toward or away from the photoconductor depending on the thickness of the copy sheet.

48 Claims, 6 Drawing Sheets

OTHER PUBLICATIONS

Patent Abstracts of Japan, vol. 10, No. 330 (P-514) (2386), published Nov. 11, 1986 for Japanese Patent Laid Open Patent Publication No. JP-A-61 137 178, published Jun. 24, 1986.

English language Abstract of Japanese Patent Laid Open Patent Publication No. 61-18972 to Murata, and a copy of Japanese Patent Laid Open Patent Publication No. 61-18972, published Jan. 27, 1986.

English language Abstract of Japanese Patent Laid Open Patent Publication No. 62-90675 to Tsuji, and a copy of Japanese Patent Laid Open Patent Publication No. 62-90675, published Apr. 25, 1987.

English language Abstract of Japanese Patent Laid Open Patent Publication No. 59-181364 to Yoshizawa and a copy of Japanese Patent Laid Open Patent Publication No. 59-181364, published Oct. 15, 1984.

Patent Abstracts of Japan, vol. 11, No. 305 (P-623), published Oct. 6, 1987, for Japanese Patent Laid Open Patent Publication No. 62-96983, published May 6, 1987, and a copy of Japanese Patent Laid Open Patent Publication No. 62-96983.

Fletcher et al., Xerox Disclosure Journal, vol. 1 No. 5, May 1976.

IMAGE-TRANSFER AND SHEET-SEPARATION APPARATUS

This application is a continuation of application Ser. No. 08/267,938, filed Jul. 6, 1994 abandoned, which is a continuation of application Ser. No. 07/958,733, filed Oct. 9, 1992, now U.S. Pat. No. 5,408,300 which applications are entirely incorporated herein by reference.

BACKGROUND OF THE INVENTION

The present invention relates to an image-transfer and sheet-separating apparatus; more particularly to an apparatus for transferring onto a copy sheet an image, retained on an image receiver, toner-developed from a positive latent image, and for separating the sheet holding the transferred image from the image receiver.

An image forming apparatus such as a copying machine will include an image-transfer and sheet-separating apparatus for transferring onto a copy sheet a toner image formed on a photoconductor drum serving as an image receiver. Conventional image-transfer and sheet-separating apparatus have an image-transfer charger for supplying a copy sheet with charge of reversed polarity to that carried by the toner, received from a corona charger, and a sheet-separating charger which functions by applying an alternating-current voltage to the copy sheet. One undesirable side effect in the conventional apparatus is, however, that environmentally undesirable ozone is generated by the corona charger.

Therefore, an image-transfer and sheet-separating apparatus employing a transfer roller and discharging unit in place of a corona charger has been taught, as has been disclosed in, for example, Japanese Laid-Open Patent Application No. 269969/1989.

The apparatus therein adopts a negative development process, by which toner is adhered to discharged (i.e., image-negative) areas of a photoconductor drum through an electric field generated by development electrodes. A DC bias voltage of reversed polarity to that of the toner adhered to the photoconductor drum is applied to the transfer roller. A copy sheet is then transported between the photoconductor drum and the transfer roller, which presses the sheet against the drum, whereupon the toner-developed image on the photoconductor drum is transferred onto the sheet by agency of the DC bias voltage applied to the transfer roller. The sheet holding the transferred image is discharged by a charge-stripping needle provided adjacent the transfer roller.

With negative-image development, adhesion of toner to the photoconductor drum is of sufficiently reduced strength as to enable image transfer at low bias voltages. Additionally, adhesion of the sheet to the photoconductor drum is such that it detaches easily merely by being discharged with the charge-stripping needle.

However, it is difficult to adapt the foregoing structure to apparatus employing positive-image development, in which toner is adhered to the charge-existing areas of the photoconductor drum. This is explained as follows.

In order to produce copies of appropriate image density, image forming apparatus employing positive-image development will not transfer toner-developed images optimally unless the bias voltage is high enough to overcome the electrostatic attraction of the toner, carrying charge of reversed polarity to that of the latent image, to the photoconductor drum. However, wherein high bias voltages are used, the charge-stripping needle is incapable of reliably stripping sufficient charge from the copy sheet, degrading the sheet-separating function. In particular, wherein the copy sheet receives scant toner, or is blank, the sheet-separating ability deteriorates to the extent that jamming occurs frequently, since the high bias voltage on the sheet attracts it to the largely discharged surface of the photoconductor drum.

SUMMARY OF THE INVENTION

It is an object of the present invention to improve the reliability of the function of separating a copy sheet from an image receiver, meanwhile maintaining optimal image transfer.

An image-transfer and sheet-separating apparatus according to an aspect of the present invention transfers onto a copy sheet an image retained on an image receiver, toner-developed developed from a positive latent image, and subsequently separates the image-holding sheet from the image receiver. In this apparatus, AC voltage superimposed on DC voltage is applied to a transfer roller which presses on the image receiver. Additionally, a charge-stripping element, which removes charge from the copy sheet, is disposed in a portion of the sheet-transport stream forward of a nipping position of the transfer roller and the image receiver.

In this image-transfer and sheet-separating apparatus, when the copy sheet is nipped between the image receiver and the transfer roller, the image retained on the image receiver, toner-developed from a positive latent image, is transferred to the sheet by agency of DC voltage, and the sheet is electrically discharged by an AC voltage. Furthermore, charge remnant on the sheet after the image transfer process is removed by the charge-stripping element disposed in a portion of the sheet-transport stream forward of the nipping position. Accordingly, charge remaining on the copy sheet is drawn off, ensuring high efficiency in image transfer and improved reliability in separating the sheet from the image receiver.

An image-transfer and sheet-separating apparatus according to another aspect transfers toner retained on the image receiver onto a copy sheet, and separates the sheet from the image receiver upon the transfer process. The apparatus includes a transfer roller which presses on the image receiver, and to which DC and AC voltages are applied.

In this apparatus, when a copy sheet is transported between the image receiver and the transfer roller, AC voltage is applied to the transfer roller for a predetermined interval (specifically, the interval during which the non-image containing portion of the sheet along its forward margin passes through the nipping position), following which DC voltage to induce image transfer is applied to the roller. Accordingly, within the interval which is from the start point of an image-transfer process to the actual onset of image transfer, the forward-end part of the sheet is discharged by AC voltage, facilitating separation of the leading edge of the sheet from the image receiver. Consequently, the reliability of sheet separation is improved, meanwhile optimal efficiency of image transfer is maintained.

BRIEF DESCRIPTION OF THE DRAWINGS

FIG. 2 is a block diagram illustrating a control unit of the first embodiment;

DESCRIPTION OF THE PREFERRED EMBODIMENTS

First Embodiment

Figure 1:
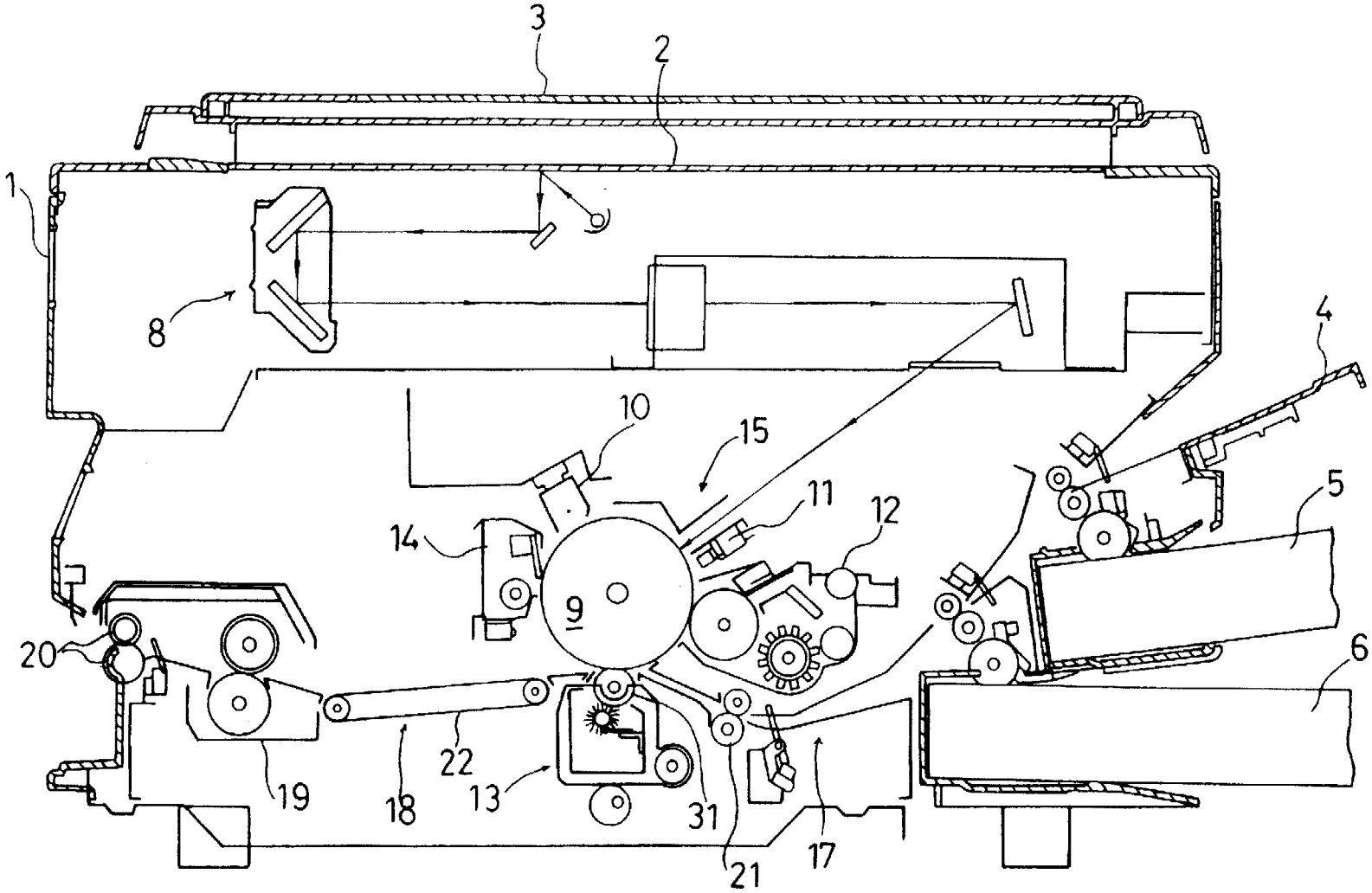
FIG. 1 is a schematic elevational view showing a copying machine incorporating a first embodiment according to the present invention.

In reference to FIG. 1, an original retainer 2 on which an original is retained is disposed in an upper portion of a copying machine body 1, and a raisable original cover 3 is provided over the upper surface of the original retainer 2. On the right side of the body 2 in the figure, a bypass tray 4 and detachable paper cassette cases 5 and 6 are attached.

Located in the upper portion of the body 1 is an optical exposure system 8 for obtaining image information from the original. The optical exposure system 8 consists of a light source, mirrors, a lens unit, etc. In the central portion of the body 1 is an image-forming section 15 comprising a photoconductor drum 9 on which an electrostatic latent image is formed and, surrounding the photoconductor drum 9, a main charger 10 for electrically charging the photoconductor drum 9 to a predetermined level; a blanking lamp 11 for discharging portions of latent image on the photoconductor drum 9 designated blank; a developing unit 12 for developing the electrostatic latent image on the photoconductor drum 9 with toner; an image-transfer and sheet-separating apparatus 13 for transferring the toner image from the photoconductor drum 9 onto a sheet, and for separating the sheet therefrom; and a cleaning unit 14 for removing excess toner from the photoconductor drum 9.

Between each of the bypass tray 4, the paper cassette case 5, and the paper cassette case 6, respectively, and the image forming section 15, paper supply paths 17 are provided. In a portion of the sheet transport stream forward of the image forming section 15, a sheet-discharging path 18 is provided. In a portion of the sheet transport stream rearward of the photoconductor drum 9, registration rollers 21 are provided, which regulate the start-timing for the transport of a copy sheet to between the photoconductor drum 9 and the image-transfer and sheet-separating apparatus 13. The sheet-discharging path 18 consists chiefly of a feed conveyer 22. In a portion of the sheet transport stream forward of the path 18, a fixing unit 19 for fixing a transferred toner image onto a transported sheet, and rollers 20 for discharging the sheet from the fixing unit 19, are also provided.

Figure 2:
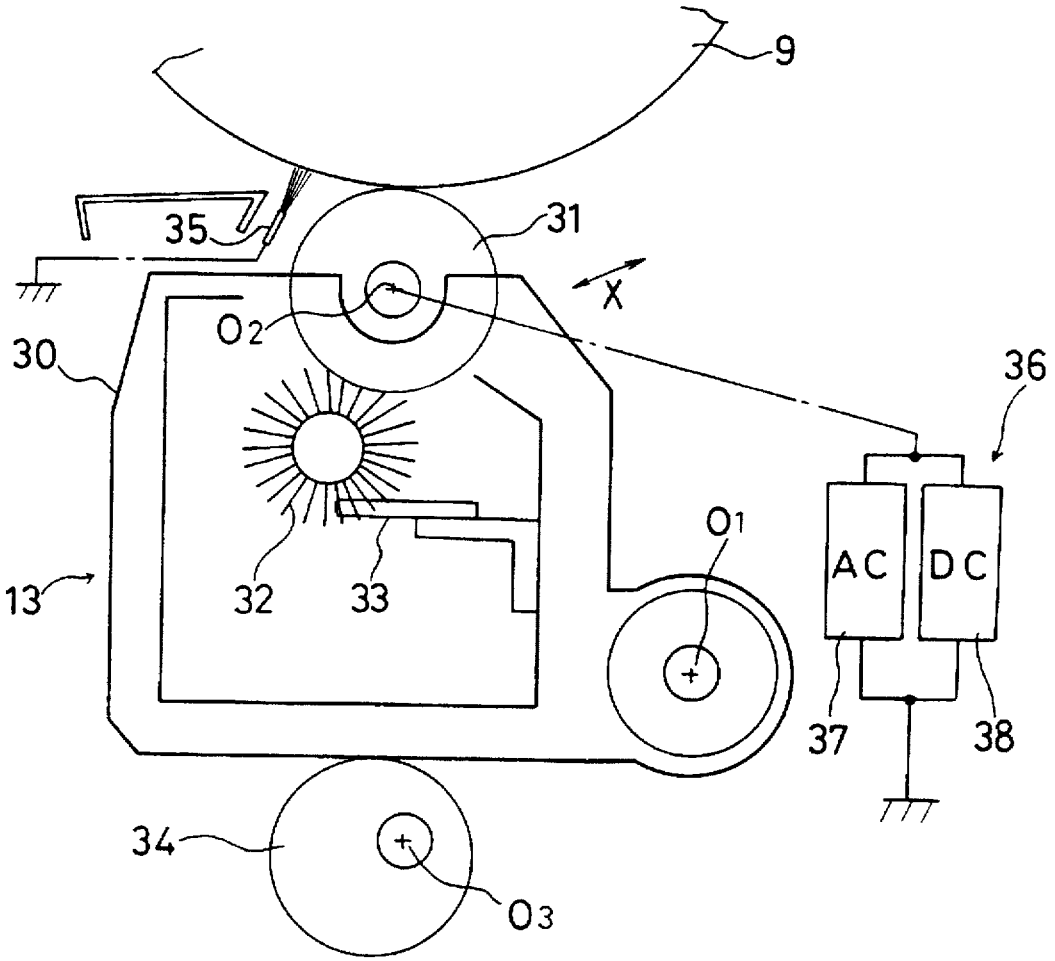
FIG. 2 is an enlarged sectional view showing the image-transfer and sheet-separating apparatus of the first embodiment.

In reference to FIG. 2, the image-transfer and sheet-separating apparatus 13 includes a case 30 pivotal along the direction indicated by arrow X about an axis $O_1$. In an upper portion of the case 30, a transfer roller 31 is rotatably supported about an axis $O_2$. The transfer roller 31 is formed from a pliable material, for example, polyurethane rubber, the resistivity of which is $10^7$ ohm centimeters and the hardness of which is 17 Shore A. An upper portion of the transfer roller 31 presses on the lower surface of the photoconductor drum 9, and the transfer roller 31 is connected to a bias power supply unit 36. The bias power supply unit 36 has an AC power supply 37 and a DC power supply 38 for applying AC and DC voltages respectively, and AC voltage superimposed on DC voltage is thereby applied to the transfer roller 31.

Within the case 30, a fibrous-brush cleaning roller 32 is disposed under and pressed against the lower surface of the transfer roller 31. The brush roller 32 is rotated by a not-indicated driving mechanism, and cleans the surface of the transfer roller. Into a lower portion of the brush roller 32, the tip of a blade 33 fixed to an inner wall of the case 30 extends. The blade 33 scrapes toner from the brush roller 32.

Under the case 30, a eccentric wheel 34 rotatable about an axis $O_3$ is disposed. Rotation of the eccentric wheel 34 about the axis $O_3$ shifts the image-transfer and sheet-separating apparatus 13 along the direction X in FIG. 2. The turning angle of the eccentric wheel 34 is given to correspond to the thickness of a copy sheet. The axes $O_1$, $O_2$ and $O_3$ lie in parallel.

In a portion of the sheet transport stream forward from the transfer roller 31, a charge-stripping brush 35 for removing charge from the reverse surface of the copy sheet is disposed. The charge-stripping brush 35 is of approximately the same length as the axial dimension of the transfer roller 31, and along the adjacent edge are conductive fibers of, for example, carbon. The tips of the charge-stripping brush 35 come into contact with the reverse surface of the copy sheet, and the opposite edge of the brush 35 is grounded. Accordingly, remnant charge on the sheet is removed.

Figure 3:
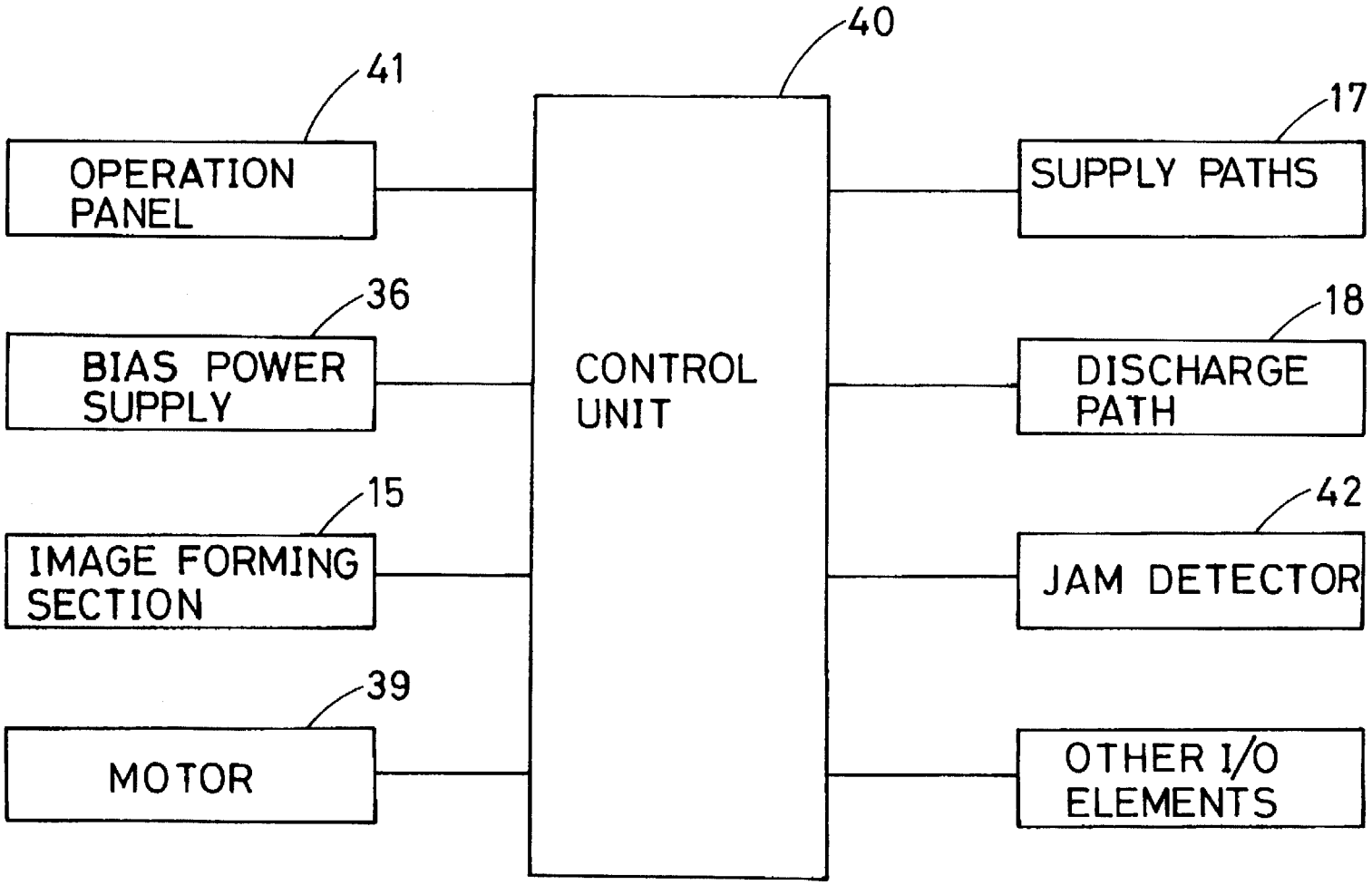
FIG. 3 is a block diagram illustrating a control unit of the first embodiment.

The copy machine includes a control unit 40 which is a microcomputer comprising a CPU, a ROM, a RAM etc., as shown FIG. 3. The control unit 40 is connected with an operation panel 41 disposed in the upper surface of the body 1. The operation panel 41 contains switches and an LED indicator. The control unit 40 is further connected with the bias power supply unit 36, a motor 39 for rotatively driving the transfer roller 31, a jam detector 42 composed of jam-detecting sensors provided in the supply paths 17 and the sheet-discharging path 18, and other input/output elements.

Figure 4:
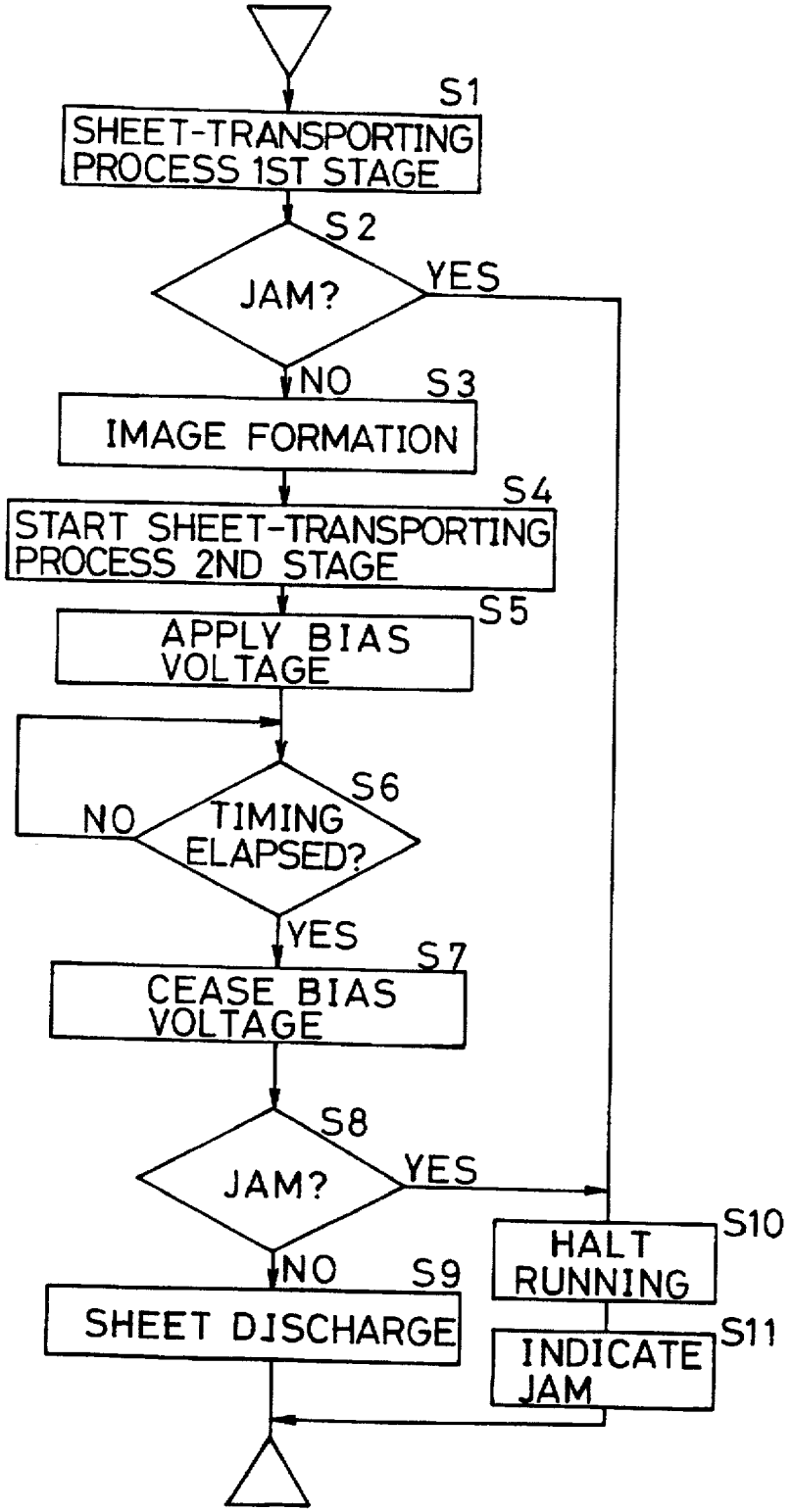
FIG. 4 is flowchart showing process control in the first embodiment.

The operation of the above embodiment will be described with reference to the flowchart shown in FIG. 4.

When a copying operation is started by pressing a print key in the operation panel 41, at step 1, the first stage in a sheet-transporting process is performed. In this first stage, a copy sheet is transported from a selected of the paper cassettes to the registration rollers 21 via corresponding supply path 17. It then is determined at step S2 whether a jam has occurred during the first stage of the sheet-transporting process. This determination is made according to the status of the sensors in the jam detector 42. If no jam has occurred, the program runs to step S3.

At step S3, an image forming process is performed by the image forming section 15. In this step, the optical exposure system 8 obtains image information from the original on the original retainer 2. An electrostatic latent image is formed on the photoconductor drum 9 corresponding to the image information. Regions of the electrostatic latent image to be blanked are discharged by the blanking lamp 11, after which the latent image is developed with toner by the developing unit 12.

Once the toner image has been formed, at step S4, the registration rollers 21 start to rotate at that timing wherein the forward end of the toner image on the drum 9 will be coincident with the forward end of the sheet, whereupon the second stage of the sheet-transport process, which includes image transfer and sheet discharge, is performed. At step S5, a bias voltage consisting of an AC voltage superimposed on a DC voltage is applied to the transfer roller 31, and the transfer process is started. Therein, the sheet is charged by the DC voltage component with a charge of polarity reversed to that of the toner, and accordingly the toner image is transferred from the photoconductor drum 9 onto the sheet.

Thereupon, the sheet is electrically discharged by the AC voltage; accordingly the possibility of separating failure is decreased.

At step S6, the program awaits the elapse of a timing corresponding to the circumferential length of the toner image on the photoconductor drum 9. When the timing has elapsed, the program proceeds to step S7. At step S7, application of the bias voltage is ceased, and the transfer process ends. It is determined at step S8 whether a jam has occurred in the second sheet-supplying process. If no jam has occurred, step S9 is executed. At step S9, the sheet-discharging path 18, the fixing unit 19 and the discharging rollers 20 are driven, and accordingly the sheet is discharged from the machine body 1.

On the other hand, if the determination at step S2 or S8 is YES, step S10 is executed in order to halt the running of all components. At step S11, the jam LED indicator in the operation panel 41 is illuminated, and an operator is thus notified that a jam has occurred. When the execution of either step S9 or step S11 has ended, the program proceeds to further steps.

Concrete examples of bias voltages employed in the sheet-separating function will be given in the following. Table 1 shows comparative examples using a DC bias voltage together with a charge-stripping element, and Table 2 shows embodiment examples using AC voltage superimposed on DC voltage in conjunction with the charge-stripping element.

TABLE 1

| Comparative Examples | DC (V) | Image Density | Separation Ability (Blank Sheet) |
|---|---|---|---|
| 1 | 500 | 1.187 | ○ |
| 2 | 1000 | 1.432 | x |
| 3 | 1500 | 1.486 | x |
| 4 | 2000 | 1.479 | x |
| 5 | 2500 | 1.473 | x |

TABLE 2

| | AC | | | | Separation Ability |
|---|---|---|---|---|---|
| Examples | Frequency (Hz) | $V_{P-P}$ (V) | DC (V) | Image Density | (Blank Sheet) |
| 1 | 500 | 500 | 500 | 1.286 | ○ |
| 2 | | 1000 | 1000 | 1.365 | ○ |
| 3 | | 1500 | 1500 | 1.443 | ○ |
| 4 | | 2000 | 2000 | 1.462 | Δ |
| 5 | 1000 | 500 | 500 | 1.273 | ○ |
| 6 | | 1000 | 1000 | 1.394 | ○ |
| 7 | | 1500 | 1500 | 1.458 | ○ |
| 8 | | 2000 | 2000 | 1.470 | ○ |
| 9 | 1500 | 500 | 500 | 1.302 | ○ |
| 10 | | 1000 | 1000 | 1.386 | ○ |
| 11 | | 1500 | 1500 | 1.451 | ○ |
| 12 | | 2000 | 2000 | 1.459 | Δ |

In Tables 1 and 2, a circle "○" indicates that no jam occurred when a blank sheet was transported; a triangle "Δ" indicate that some form of jamming occurred; and an "x" indicates that sheet separation was not executed satisfactorily, such that severe jamming occurred.

As is apparent from Table 1, in the cases wherein only DC bias voltage is used in the positive-image development process, image density (ID) does not attain the 1.3 mark (on an arbitrary scale of comparison), below which inadequate image transfer efficiency is indicated, or more unless the bias voltage applied is 1000 V or greater. Furthermore, wherein the bias voltage applied is 1000 V or greater, the charge-stripping element is incapable of stripping sufficient charge, such that the sheet is not separated from the photoconductor drum.

In contrast, the application of AC voltage superimposed on DC voltage provides toner-developed images of sufficient density with bias voltages of 500 to 2000 V, meanwhile sheet separation is executed satisfactorily. It is apparent from Table 2 that the more preferable range of AC voltage is 1000 to 1500 V, regardless of frequency, and that the more preferable range of DC voltage is 1000 to 1500 V. In this range, when the bias voltage comprising AC superimposed on DC is applied, the image transfer efficiency is optimal and sheet separation is executed reliably.

Second Embodiment

Figure 5:
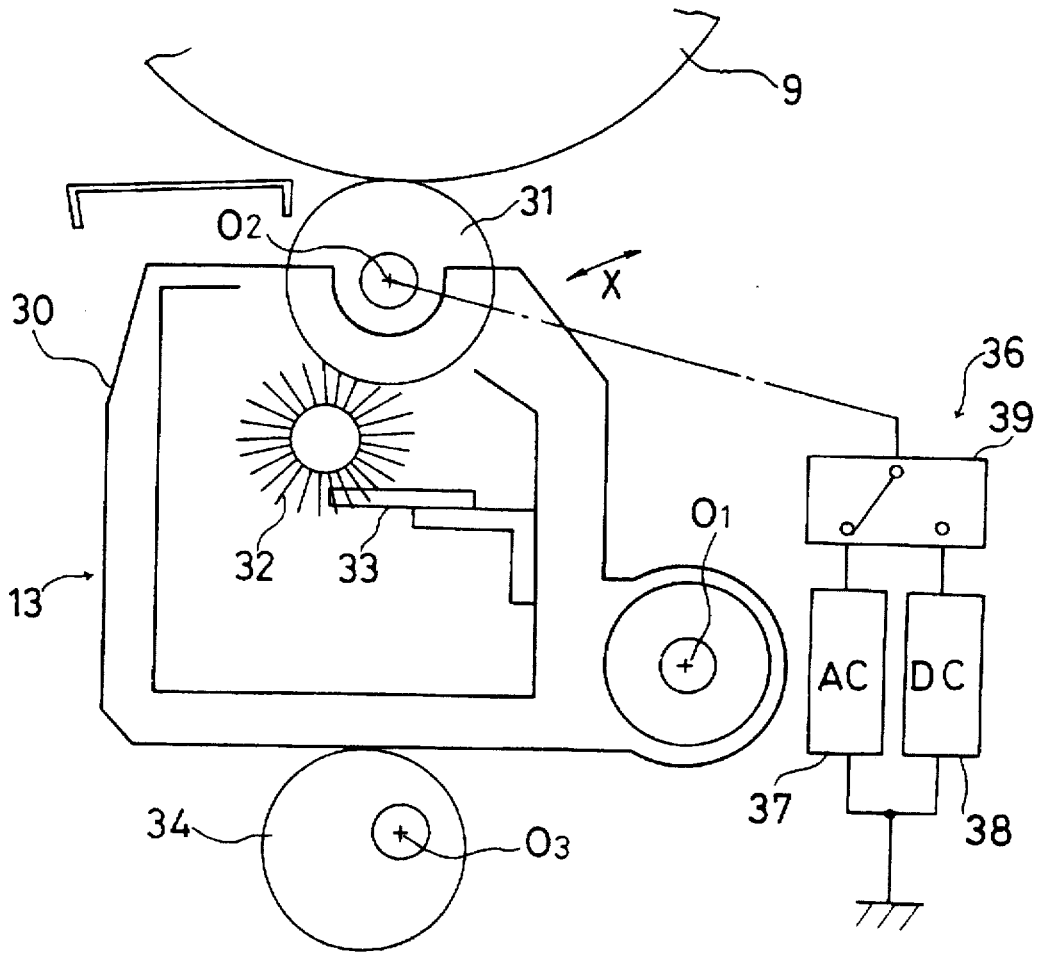
FIG. 5 is a view of a second embodiment, corresponding to FIG. 2.

In this embodiment, a bias power supply unit 36 as seen in FIG. 5 includes an AC power supply 37, and a DC power supply 38, and a switch 39 for switching between either one; and accordingly the bias power supply unit 36 is capable of selectively supplying either AC voltage or DC voltage.

Figure 6:
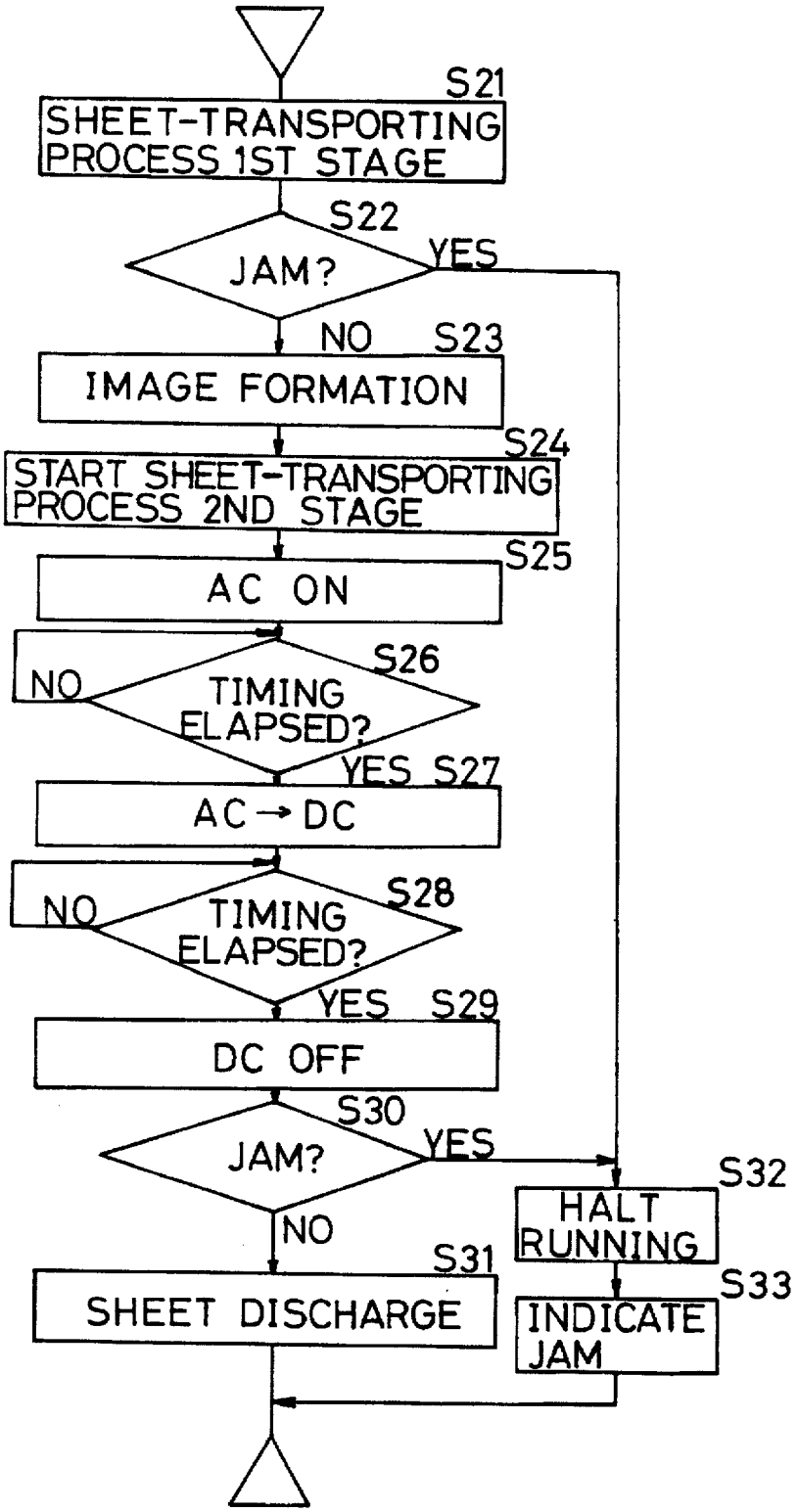
FIG. 6 is a flowchart pertaining to the second embodiment, corresponding to FIG. 4.

The operation of the second embodiment will be described with reference to the flowchart shown in FIG. 6.

As the print key in the operation panel 41 is pressed, the first stage in the sheet-transporting process, which supplies a sheet from a selected of the paper cassettes to the registration rollers 21 via the corresponding supply path 17, is carried out at step S21. At step S22, it is determined whether sheet jamming has occurred in the first stage sheet-transporting process. This determination is made according to the status of the sensors comprising the jam detector 42. If no jam has occurred, the program proceeds to step S23.

At step S23, an image forming process is carried out by the image forming section 15. In this process, the optical exposure system 8 obtains image information from the original on the original retainer 2, and an electrostatic latent image is formed on the photoconductor drum 9 corresponding to the image information. Regions of the electrostatic latent image on the photoconductor drum 9 to be blanked are discharged by the blanking lamp 11, after which the latent image is developed with toner by the developing unit 12.

At step S24, the registration rollers 21 start to rotate at that timing wherein the forward end of the toner image on the drum 9 will be coincident with the forward end of the sheet, and thereupon the second stage of the sheet-transport process, for image transfer and sheet discharge, is carried out. At step S25, the switch 37 of the bias power supply unit 36 is changed over to the AC power supply 38, switching it on, whereby AC bias voltage is applied to the transfer roller 31. Accordingly, the sheet is discharged and its forward end is separated from the photoconductor drum 9. The program awaits elapse of the predetermined timing at step S26. The predetermined timing is equivalent to that interval till the non-image area of the forward end of a sheet (about 5 mm in length from the sheet's tip) passes the nipping position.

When the timing has elapsed, the program runs to step S27. There, the switch 37 is changed over to the DC power supply 39, switching it on, shifting the voltage from AC to DC bias voltage. Thus the image transfer process is started, and accordingly the toner image on the photoconductor drum 9 is transferred to the sheet. AT step S28, the program awaits a timing corresponding to the circumferential length of the toner image on the photoconductor drum 9.

When the timing of step S28 has elapsed, the program proceeds to step S29. At step S29, the DC power supply 39 is switched off, accordingly the application of bias voltage is stopped and the image transfer process ends. At step S30, it is determined whether jamming has occurred in the second sheet-supplying process. If not, the program proceeds to step S31. At step S31, the sheet-discharging path 18, the fixing unit 19 and discharging rollers 20 are driven respectively; and accordingly the sheet is discharged from the body 1.

On the other hand, wherein it is determined that a jam has occurred at either step S22 or S30, the program proceeds to step S32. At step S32, all running components are halted. At step S33, the jam LED indicator in the operation panel 41 is illuminated, notifying an operator that a jam has occurred. After the execution of either step S31 or step S33, the program proceeds to subsequent steps.

In this embodiment, AC voltage is applied to the transfer roller while the non-image area in the forward end of the sheet is in the nipping position, thereby the non-image area on the sheet is discharged, accordingly separating the forward end of the sheet from the photoconductor drum 9 such that it cannot be re-attracted by the photoconductor drum.

MODIFICATIONS (a) In the above embodiments, the present invention is applied to a copying machine; however, the present invention may be applied to other image forming apparatus such as a laser-printer, etc.

(b) In the foregoing embodiments, the toner-developed image is transferred from a photoconductor drum to a sheet, however the present invention may be applied in cases such as those wherein a toner image is transferred from a transfer drum or a transfer belt, as in a color copying machine.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An apparatus for transferring onto a sheet an image retained on an image receiver and toner-developed from a positive latent image, and for subsequently separating the sheet from the image receiver, comprising:

a transfer roller pressing on the image receiver for applying a bias voltage to the sheet, the bias voltage being within the range of 500 V to 2000 V and being composed of an AC voltage within the range of 1000 V to 1500 V superimposed on a DC voltage, such that the DC voltage charges the sheet with a charge having a polarity opposite to a charge carried by the toner that causes the toner-developed image to adhere to the image receiver, the DC voltage opposite polarity charge inducing transfer of the toner-developed image from the image receiver onto the sheet, and the AC voltage electrically discharges the sheet from the transfer roller;

a bias voltage supply unit connected to the transfer roller; and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

2. An apparatus according to claim 1, wherein said means for applying a bias voltage composed of an AC voltage superimposed on a DC voltage includes a power supply unit having an AC power supply section and a DC power supply section.

3. An apparatus according to claim 1, wherein said image receiver is a rotatable photoconductor drum.

4. An apparatus according to claim 3, wherein said transfer roller is disposed in a position under and axially parallel with the photoconductor drum.

5. An apparatus according to claim 3, further including a case, an upper portion of which rotatably supports the transfer roller, said case being provided under the photoconductor drum.

6. An apparatus according to claim 5, wherein said case is pivotally supported along one end of an underside thereof.

7. An apparatus according to claim 5, further including means for moving the transfer roller toward and away from the photoconductor drum.

8. An apparatus according to claim 7, wherein the means for moving the transfer roller toward and away from the photoconductor drum includes a rotatable eccentric wheel in contact with the underside of the case.

9. An apparatus according to claim 5, further including:

a fibrous brush roller rotatably provided in the case and pressing on a lower surface of the transfer roller; and a blade, having a tip extending into a lower portion of the fibrous brush roller, provided in the case.

10. An apparatus according to claim 1, wherein the charge-stripping brush contains conductive fibers.

11. An apparatus according to claim 10, wherein said conductive fibers are carbon fibers.

12. An apparatus according to claim 1, wherein the charge-stripping brush is grounded.

13. An apparatus for transferring onto a sheet an image retained on an image receiver and toner-developed from a positive latent image, and for subsequently separating the sheet from the image receiver, comprising:

a transfer roller pressing on the image receiver for applying a bias voltage to the sheet, the bias voltage being within the range of 500 V to 2000 V and being composed of an AC voltage superimposed on a DC voltage, the DC voltage being within the range of 1000 V to 1500 V, such that the DC voltage charges the sheet with a charge having a polarity opposite to a charge carried by the toner that causes the toner-developed image to adhere to the image receiver, the DC voltage opposite polarity charge inducing transfer of the toner-developed image from the image receiver onto the sheet, and the AC voltage electrically discharges the sheet from the transfer roller;

a bias voltage supply unit connected to the transfer roller; and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

14. An apparatus for transferring onto a sheet an image retained on a rotatable photoconductor drum and toner-developed from a positive latent image, and for subsequently separating the sheet from the photoconductor drum, comprising:

a transfer roller pressing on the photoconductor drum for applying a bias voltage to the sheet, the bias voltage being composed of an AC voltage superimposed on a DC voltage, such that the DC voltage charges the sheet with a charge having a polarity opposite to a charge carried by the toner that causes the toner-developed image to adhere to the photoconductor drum, the DC voltage opposite polarity charge inducing transfer of the toner-developed image from the photoconductor drum onto the sheet, and the AC voltage electrically discharges the sheet from the transfer roller;

a bias voltage supply unit connected to the transfer roller;

a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image;

a case provided under the photoconductor drum, an upper portion of the case rotatably supporting the transfer roller; and moving means for moving the transfer roller toward and away from the photoconductor drum, the moving means including a rotatable eccentric wheel in contact with an underside of the case, a turning angle of the eccentric wheel corresponding to a thickness of the sheet.

15. An image reproducing apparatus comprising:

a scanning unit for obtaining image information corresponding to an original image;

an image forming unit including an image receiver, for developing a latent image corresponding to the image information retained on the image receiver with toner; and an image-transfer and sheet separating apparatus for transferring onto a sheet the toner-developed image retained on the image receiver, and for subsequently separating the sheet from the image receiver, the image-transfer and sheet-separating apparatus including a transfer roller pressing on the image receiver, for applying a bias voltage to the sheet, the bias voltage being within the range of 500 V to 2000 V and being composed of an AC voltage within the range of 1000 V to 1500 V superimposed on a DC voltage, a bias voltage supply unit connected to the transfer roller, and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

16. An apparatus according to claim 15, wherein said means for applying a bias voltage composed of an AC voltage superimposed on a DC voltage includes a power supply unit having an AC power supply section and a DC power supply section.

17. An apparatus according to claim 15, wherein said image receiver is a rotatable photoconductor drum.

18. An apparatus according to claim 17, wherein said transfer roller is disposed in a position under and axially parallel with the photoconductor drum.

19. An apparatus according to claim 17, further including a case, an upper portion of which rotatably supports the transfer roller, said case being provided under the photoconductor drum.

20. An apparatus according to claim 19, wherein said case is pivotally supported along one end of an underside thereof.

21. An apparatus according to claim 19, further including means for moving the transfer roller toward and away from the photoconductor drum.

22. An apparatus according to claim 21, wherein the means for moving the transfer roller toward and away from the photoconductor drum includes a rotatable eccentric wheel in contact with the underside of the case.

23. An apparatus according to claim 19, further including:

a fibrous brush roller rotatably provided in the case and pressing on a lower surface of the transfer roller; and a blade, having a tip extending into a lower portion of the fibrous brush roller, provided in the case.

24. An apparatus according to claim 15, wherein the charge-stripping brush contains conductive fibers.

25. An apparatus according to claim 24, wherein said conductive fibers are carbon fibers.

26. An apparatus according to claim 15, wherein the charge-stripping brush is grounded.

27. An image reproducing apparatus comprising:

a scanning unit for obtaining image information corresponding to an original image;

an image forming unit including an image receiver for developing a latent image corresponding to the image information retained on the image receiver with toner; and an image-transfer and sheet separating apparatus for transferring onto a sheet the toner-developed image retained on the image receiver, and for subsequently separating the sheet from the image receiver, the image-transfer and sheet-separating apparatus including a transfer roller pressing on the image receiver, for applying a bias voltage to the sheet, the bias voltage being within the range of 500 V to 2000 V and composed of an AC voltage superimposed on a DC voltage, the DC voltage being within the range of 1000 V to 1500 V, a bias voltage supply unit connected to the transfer roller, and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

28. An image reproducing apparatus comprising:

a scanning unit for obtaining image information corresponding to an original image;

an image forming unit including a rotatable photoconductor drum for developing a latent image corresponding to the image information retained on the photoconductor drum with toner; and an image-transfer and sheet separating apparatus for transferring onto a sheet the toner-developed image retained on the photocondutor drum, and for subsequently separating the sheet from the photoconductor drum, the image-transfer and sheet-separating apparatus including a transfer roller pressing on the photoconductor drum, for applying a bias voltage composed of an AC voltage superimposed on a DC voltage to the sheet, a bias voltage supply unit connected to the transfer roller, and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image;

a case provided under the photoconductor drum, an upper portion the case rotatably supporting the transer roller; and moving means for moving the transfer roller toward and away from the photoconductor drum, the moving means including a rotatable eccentric wheel in contact with an underside of the case, a turning angle of the eccentric wheel corresponding to a thickness of the sheet.

29. An apparatus for transferring onto a sheet an image retained on an image receiver and toner-developed from a positive latent image, and for subsequently separating the sheet from the image receiver, comprising:

a transfer roller pressing on the image receiver for applying a bias voltage to the sheet, the bias voltage being composed of an AC voltage within the range of 1000 V to 1500 V superimposed on a DC voltage, such that the DC voltage charges the sheet with a charge having a polarity opposite to a charge carried by the toner that causes the toner-developed image to adhere to the image receiver, the DC voltage opposite polarity charge inducing transfer of the toner-developed image from the image receiver onto the sheet, and the AC voltage electrically discharges the sheet from the transfer roller;

a bias voltage supply unit connected to the transfer roller; and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

30. An apparatus for transferring onto a sheet an image retained on an image receiver and toner-developed from a positive latent image, and for subsequently separating the sheet from the image receiver, comprising:

a transfer roller pressing on the image receiver for applying a bias voltage to the sheet, the bias voltage being composed of an AC voltage superimposed on a DC voltage, the DC voltage being within the range of 1000 V to 1500 V, such that the DC voltage charges the sheet with a charge having a polarity opposite to a charge carried by the toner that causes the toner-developed image to adhere to the image receiver, the DC voltage opposite polarity charge inducing transfer of the toner-developed image from the image receiver onto the sheet, and the AC voltage electrically discharges the sheet from the transfer roller;

a bias voltage supply unit connected to the transfer roller; and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

31. An image reproducing apparatus comprising:

a scanning unit for obtaining image information corresponding to an original image;

an image forming unit including an image receiver for developing a latent image corresponding to the image information retained on the image receiver with toner; and an image-transfer and sheet separating apparatus for transferring onto a sheet the toner-developed image retained on the image receiver, and for subsequently separating the sheet from the image receiver, the image-transfer and sheet-separating apparatus including a transfer roller pressing on the image receiver, for applying a bias voltage to the sheet, the bias voltage being composed of an AC voltage within the range of 1000 V to 1500 V superimposed on a DC voltage, a bias voltage supply unit connected to the transfer roller, and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

32. An image reproducing apparatus comprising:

a scanning unit for obtaining image information corresponding to an original image;

an image forming unit including an image receiver for developing a latent image corresponding to the image information retained on the image receiver with toner; and an image-transfer and sheet separating apparatus for transferring onto a sheet the toner-developed image retained on the image receiver, and for subsequently separating the sheet from the image receiver, the image-transfer and sheet-separating apparatus including a transfer roller pressing on the image receiver, for applying a bias voltage to the sheet, the bias voltage being composed of an AC voltage superimposed on a DC voltage, the DC voltage being within the range of 1000 V to 1500 V, a bias voltage supply unit connected to the transfer roller, and a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

33. An image forming and transferring apparatus in a photocopying machine, comprising:

an image receiver disposed centrally within the photocopying machine;

a main charger disposed in a position adjacent to and above the image receiver, for electrically charging the image receiver to a predetermined level, such that an electrostatic positive latent image may be formed thereon;

a developing unit for developing an electrostatic positive latent image on the image receiver with toner;

a transfer roller pressing on the image receiver, for transferring a toner-developed image retained on the image receiver onto a sheet;

means for separating the sheet from the image receiver by applying a bias voltage to the sheet through the transfer roller, the bias voltage being composed of an AC voltage superimposed on a DC voltage, the DC voltage being within the range of 1000 V to 1500 V, such that the DC voltage charges the sheet with a charge having a polarity opposite to a charge carried by the toner that causes the toner-developed image to adhere to the image receiver, the DC voltage opposite polarity charge inducing transfer of the toner developed image from the image receiver onto the sheet, and the AC voltage electrically discharges the sheet from the transfer roller;

a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

34. An apparatus according to claim 33, wherein said bias voltage applied to said transfer roller is within the range of 500 V to 2000 V.

35. An apparatus according to claim 33, wherein said means for separating the sheet from said image receiver includes a power supply unit having an AC power supply section and a DC power supply section.

36. An apparatus according to claim 33, wherein said image receiver is a rotatable photoconductor drum.

37. An apparatus according to claim 36, wherein said transfer roller is disposed in a position under and axially parallel with the photoconductor drum.

38. An apparatus according to claim 36, further including a case, an upper portion of which rotatably supports the transfer roller, said case being provided under the photoconductor drum.

39. An apparatus according to claim 38, wherein said case is pivotally supported along one end of an underside thereof.

40. An apparatus according to claim 38, further including means for moving the transfer roller toward and away from the photoconductor drum.

41. An apparatus according to claim 40, wherein said means for moving said transfer roller toward and away from said photoconductor drum includes a rotatable eccentric wheel in contact with said underside of the case.

42. An apparatus according to claim 39, further including:

a fibrous brush roller rotatably provided in said case and pressing on a lower surface of said transfer roller; and a blade, having a tip extending into a lower portion of said fibrous brush roller, provided in the case.

43. An apparatus according to claim 33, wherein said charge-stripping brush contains conductive fibers.

44. An apparatus according to claim 43, wherein said conductive fibers are carbon fibers.

45. An apparatus according to claim 33, wherein the charge-stripping brush is grounded.

46. An image forming and transferring apparatus in a photocopying machine, comprising:

an image receiver disposed centrally within the photocopying machine;

a main charger disposed in a position adjacent to and above the image receiver, for electrically charging the image receiver to a predetermined level, such that an electrostatic positive latent image may be formed thereon;

a developing unit for developing an electrostatic positive latent image on the image receiver with toner;

a transfer roller pressing on the image receiver, for transferring a toner-developed image retained on the image receiver onto a sheet;

means for separating the sheet from the image receiver by applying a bias voltage to the sheet through the transfer roller, the bias voltage being composed of an AC voltage within the range of 1000 V to 1500 V superimposed on a DC voltage, such that the DC voltage charges the sheet with a charge having a polarity opposite to a charge carried by the toner that causes the toner-developed image to adhere to the image receiver, the DC voltage opposite polarity charge inducing transfer of the toner developed image from the image receiver onto the sheet, and the AC voltage electrically discharges the sheet from the transfer roller;

a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

47. An image forming and transferring apparatus in a photocopying machine, comprising:

an image receiver disposed centrally within the photocopying machine;

a main charger disposed in a position adjacent to and above the image receiver, for electrically charging the image receiver to a predetermined level, such that an electrostatic positive latent image may be formed thereon;

a developing unit for developing an electrostatic positive latent image on the image receiver with toner;

a transfer roller pressing on the image receiver, for transferring a toner-developed image retained on the image receiver onto a sheet;

means for separating the sheet from the image receiver by applying a bias voltage to the sheet through the transfer roller, the bias voltage being within the range of 500 V to 2000 V and composed of an AC voltage superimposed on a DC voltage being within the range of 1000 V to 1500 V, such that the DC voltage charges the sheet with a charge having a polarity opposite to a charge carried by the toner that causes the toner-developed image to adhere to the image receiver, the DC voltage opposite polarity charge inducing transfer of the toner developed image from the image receiver onto the sheet, and the AC voltage electrically discharges the sheet from the transfer roller;

a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image.

48. An apparatus in a photocopying machine, comprising:

a rotatable photoconductor drum disposed centrally within the photocopying machine;

a main charger disposed in a position adjacent to and above the photoconductor drum, for electrically charging the photoconductor drum to a predetermined level, such that an electrostatic positive latent image may be formed thereon;

a developing unit for developing an electrostatic positive latent image on the photoconductor drum with toner;

a transfer roller pressing on the photoconductor drum, for transferring a toner-developed image retained on the photoconductor drum onto a sheet;

means for separating the sheet from the photoconductor drum by applying a bias voltage to the sheet through the transfer roller, the bias voltage being composed of an AC voltage superimposed on a DC voltage, such that the DC voltage charges the sheet with a charge having a polarity opposite to a charge carried by the toner that causes the toner-developed image to adhere to the photoconductor drum, the DC voltage opposite polarity charge inducing transfer of the toner developed image from the photoconductor drum onto the sheet, and the AC voltage electrically discharges the sheet from the transfer roller;

a charge-stripping brush for removing remnant electric charge from the sheet after the sheet is discharged by the AC voltage, the charge-stripping brush being provided in a position forward of the transfer roller along a transport direction of the sheet during the image transferring, such that an edge of the brush contacts a surface of the sheet opposite to that containing the transferred toner-developed image;

a case provided under the photoconductor drum, an upper portion of the case rotatably supporting the transfer roller; and moving means for moving the transfer roller toward and away from the photoconductor drum, the moving means including a rotatable eccentric wheel in contact with an underside of the case, a turning angle of the eccentric wheel corresponding to a thickness of the sheet.

* * * * *